US005828363A

United States Patent [19]

Yaniger et al.

[11] Patent Number: 5,828,363

[45] **Date of Patent: *Oct. 27, 1998**

[54] FORCE-SENSING POINTING DEVICE

[75] Inventors: Stuart I. Yaniger; Mark C. Pickett, both of Ventura, Calif.

[73] Assignee: Interlink Electronics, Inc., Camarillo, Calif.

[ * ] Notice: The term of this patent shall not extend beyond the expiration date of Pat. No. 5,659,334.

[21] Appl. No.: 912,733

[22] Filed: Aug. 18, 1997

Related U.S. Application Data

[63] Continuation of Ser. No. 168,632, Dec. 15, 1993, Pat. No. 5,659,334.

[51] Int. Cl.[6] ..... G09G 5/00

[52] U.S. Cl. ..... 345/156; 345/161; 341/34; 200/6 R

[58] Field of Search ..... 345/156, 160, 345/161; 341/34; 273/148 B; 200/6 R, 6 A, 6 C

[56] References Cited

U.S. PATENT DOCUMENTS

| | | | |
|---|---|---|---|
| 3,464,531 | 9/1969 | Herr et al. . | |
| 4,168,405 | 9/1979 | Raab et al. . | |
| 4,246,452 | 1/1981 | Chandler . | |
| 4,313,113 | 1/1982 | Thornburg . | |
| 4,489,302 | 12/1984 | Eventoff . | |
| 4,680,577 | 7/1987 | Straayer et al. . | |
| 4,748,441 | 5/1988 | Breezinski . | |
| 4,949,080 | 8/1990 | Mikan . | |
| 5,065,146 | 11/1991 | Garrett . | |
| 5,159,159 | 10/1992 | Asher . | |
| 5,174,101 | 12/1992 | Bates . | |
| 5,231,386 | 7/1993 | Brandenburg et al. . | |
| 5,659,334 | 8/1997 | Yaniger et al. | 345/156 |

FOREIGN PATENT DOCUMENTS

| | | |
|---|---|---|
| 0 616 298 A1 | 9/1994 | European Pat. Off. . |
| 9209996 | 6/1992 | WIPO . |
| WO93/07606 | 4/1993 | WIPO . |

OTHER PUBLICATIONS

"Joystick Function for Touch–Sensitive Input Devices,"; IBM Technical Disclosure Bulletin, vol. 35, No. 4B, Sep. 1992, pp. 484–488.

"That Thinking Feeling," PC User, vol. 16, No. 200, Dec. 1992, p. 35.

J. E. Fox, "Keyboard Scanned Capacitive Joy Stick Cursor Control," IBM Technical Disclosure Bulletin, vol. 23, No. 8, Jan. 1981, pp. 3831–3834.

R. W. Truelson, "Single–Key Cursor Control," IBM Technical Disclosure Bulletin, vol. 26, No. 7B, Dec. 1983, pp. 3746–3747.

*Primary Examiner*—Amare Mengistu
*Attorney, Agent, or Firm*—Brooks & Kushman P.C.

[57] ABSTRACT

A thermally stable, mass-producible pointing device (10) producing an analog signal proportional to an applied force comprises actuator (20), including an arm (22) and a force transfer member (26), a connector (44), and a sensor (50). The connector maintains the force transfer member in contact with the sensor yet allows the force transfer member to change dimensions with ambient temperature without inducing stresses detectable by the sensor. In a preferred embodiment, the connector comprises an elastomeric adhesive and the sensor comprises a force-sensing resistor. The force transfer member is prevented from coming out of the assembly either by a retainer (12) comprising a shell or a potting compound retaining the force transfer member but permitting thermal expansion or contraction of the force transfer member. The force transfer member typically has a rounded or bevelled bottom surface (28) so the actuator rocks under an applied force. The area of the bottom surface of the force transfer member transferring the force changes as the actuator rocks, and the force is transferred to the sensor at a single contiguous area whose position changes in response to a change in force.

2 Claims, 6 Drawing Sheets

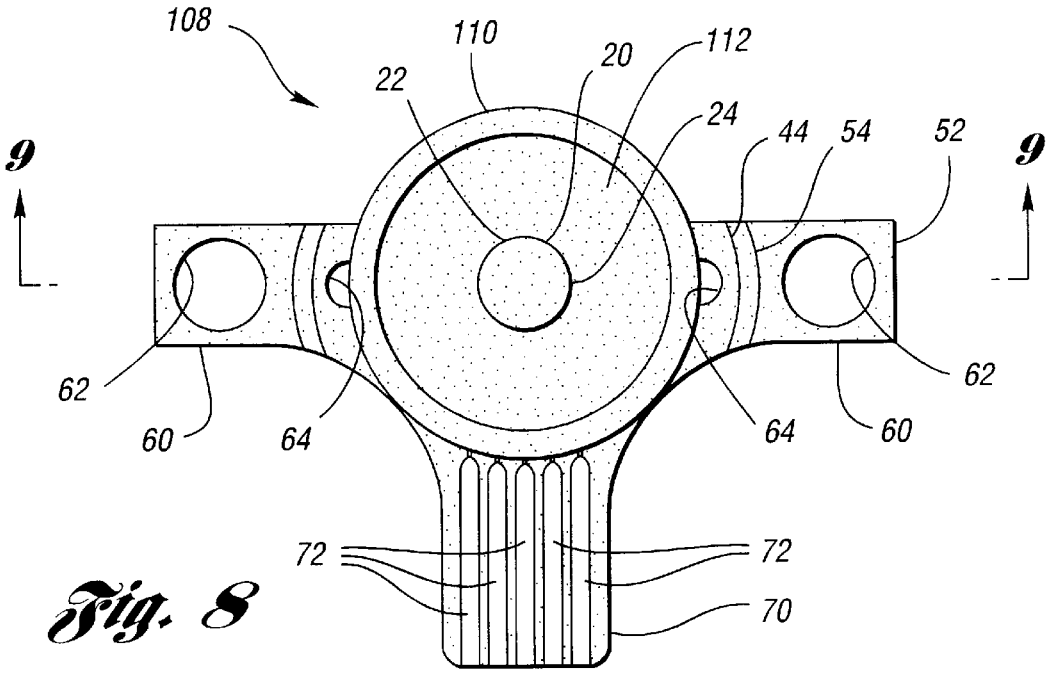
Fig. 8
Fig. 9
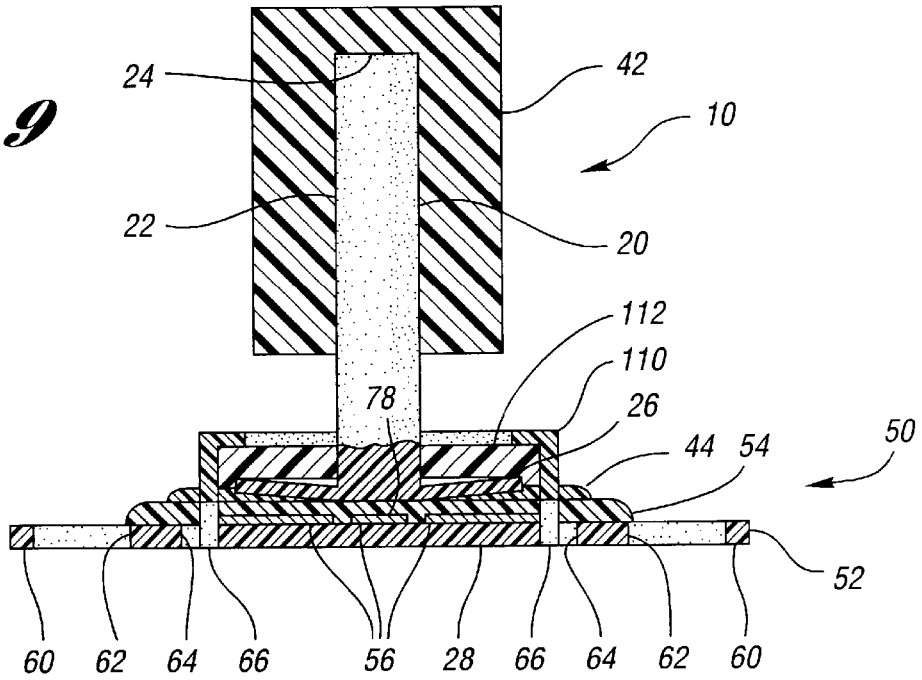

FORCE-SENSING POINTING DEVICE

This is a continuation of application Ser. No. 08/168,632 filed on Dec. 15, 1993 is now U.S. Pat. No. 5,659,334.

TECHNICAL FIELD

This invention relates to a method and an apparatus for a force-sensing analog user interface for an electronic device and, in particular, to a force-sensing pointing device.

BACKGROUND OF THE INVENTION

User interfaces are used to enter information into an electronic device. For example, pointing devices, such as a joystick, mouse, and trackball, are typically used to position a cursor on a screen. A mouse and a trackball typically use electro-mechanical or optical systems to convert a rotational motion of a ball to a linear motion of a cursor. Joysticks typically include an array of digital contact switches that detect when the joystick is moved in a particular direction.

More sophisticated analog pointing devices control the speed and direction of cursor movement by sensing the magnitude and direction of a force applied to the pointing device. For example, to use the Porta-Point™ and Dura-Point™ pointing devices sold by Interlink electronics of Camarillo, Calif., a computer operator presses an elastomeric pad that covers an array of four force-sensing resistors. The cursor then moves in a direction and at a speed corresponding to the direction and pressure of the operator's touch.

Although pointing devices that comprise an elastomeric pressure sensitive pad are ergonomically desirable, joysticks have already achieved widespread consumer recognition and acceptance. A low cost, accurate force-sensing joystick for use in consumer electronics is, therefore, desirable. Force-sensing joysticks typically use strain gauge sensors mounted on a portion of the device that bends under an applied force. For example, International Patent Application PCT/US90/06831 of Rutledge and Selker for "Analog Input Device Located in the Primary Typing Area of a Keyboard" describes a stain gauge sensor positioned on a cantilever arm that bends as force is applied to a combined alphanumeric key/joystick. Such strain gauge sensors are relatively expensive and, therefore, increase the cost of a computer utilizing a pointing device incorporating such sensors.

Another disadvantage of current force-sensing joysticks is temperature sensitivity. As the ambient temperature changes, mechanical parts of the joystick assembly expand or contract. This dimensional change can induce in the joystick assembly stresses that are detected by the force sensor. For example, U.S. Pat. No. 5,231,386 to Brandenburg et al. for "Keyswitch-Integrated Pointing Assembly" describes a combined alphanumeric key/joystick in which the key/joystick rests on four pads, each pad activating a sensor. The key/joystick is held in contact with the sensors by rigid fasteners. The stress in the sensors changes in response to a change in ambient temperature. Compensation schemes that correct for temperature sensitivity can add complexity and cost to the joystick. The problem of temperature instability is more acute in portable devices used in a wide variety of locations and environments. Likewise, the strain gauge device described in application PCT/U.S.90/06831 shows tremendous sensitivity to temperature variations.

SUMMARY OF THE INVENTION

An object of the present invention is, therefore, to produce a low-cost, force-sensing user interface device.

Another object of this invention is to produce such a device for use in a wide variety of environments.

A further object of this invention is to produce such a device for use as a user interface in a portable electronic device.

Yet another object of this invention is to produce a low-cost, force-sensing pointing device for controlling a cursor on a computer display.

The present invention is a method and an apparatus for entering information into an electronic device through the use of a pointing device and a method of making a pointing device. A pointing device of the present invention produces an analog electrical signal in response to an applied force. The magnitude of the electrical signal typically corresponds to the direction and velocity of cursor movement on a display. The invention includes an actuator having an arm with a force transfer member at one end. The force transfer member is held by a connector in a position next to a force sensor. The connector maintains the force transfer member in position but allows the force transfer member to change dimensions as the ambient temperature changes without inducing forces that significantly affect the sensor output.

In a preferred embodiment, the connector includes an elastomeric adhesive that holds the force transfer member to the sensor. The elastomeric properties of the connector allow a small amount of travel of the arm of the actuator while maintaining the actuator in contact with the sensor. A retainer limits the maximum travel distance of the arm, thereby preventing separation of the actuator form the connector, but leaves the actuator relatively free to change dimensions in response to ambient temperature changes.

When an operator applies a force to the arm, the force transfer member responsively applies pressure to the force sensors. A preferred force transfer member has a rounded or bevelled bottom surface so the actuator rocks slightly under an applied force. The portion of the bottom surface of the force transfer member that transfers the force changes as the actuator rocks, and the force is transferred to the sensor through a single contiguous area that changes position as the applied force changes. The sensor converts the applied force to a change in an electrical signal. The electrical signal is typically converted into cursor movement or other change in an electronic device.

A pointing device of the present invention can have a very small maximum travel distance of the actuator, resulting in a close approximation to an ergonomically desired isometric pointing device. The low cost, small size, and thermal stability of the present invention make it particularly suitable for use on a keyboard, where it can be positioned between or separate from the alphanumeric keys, or combined with an alphanumeric key.

Additional objects and advantages of the present invention will be apparent from the following detailed description of preferred embodiments thereof, which proceeds with reference to the accompanying drawings.

BRIEF DESCRIPTION OF THE DRAWINGS

FIG. 8 is a plan view of the pointing device of FIG. 7.

FIG. 9 is a sectional view taken along the line 9—9 device of FIG. 8 showing in exaggerated detail the curvature of the bottom of the force transfer member and the thicknesses of the elastomeric adhesive, semiconductive layer, and conductive layers.

DETAILED DESCRIPTION OF PREFERRED EMBODIMENTS

Figure 1:
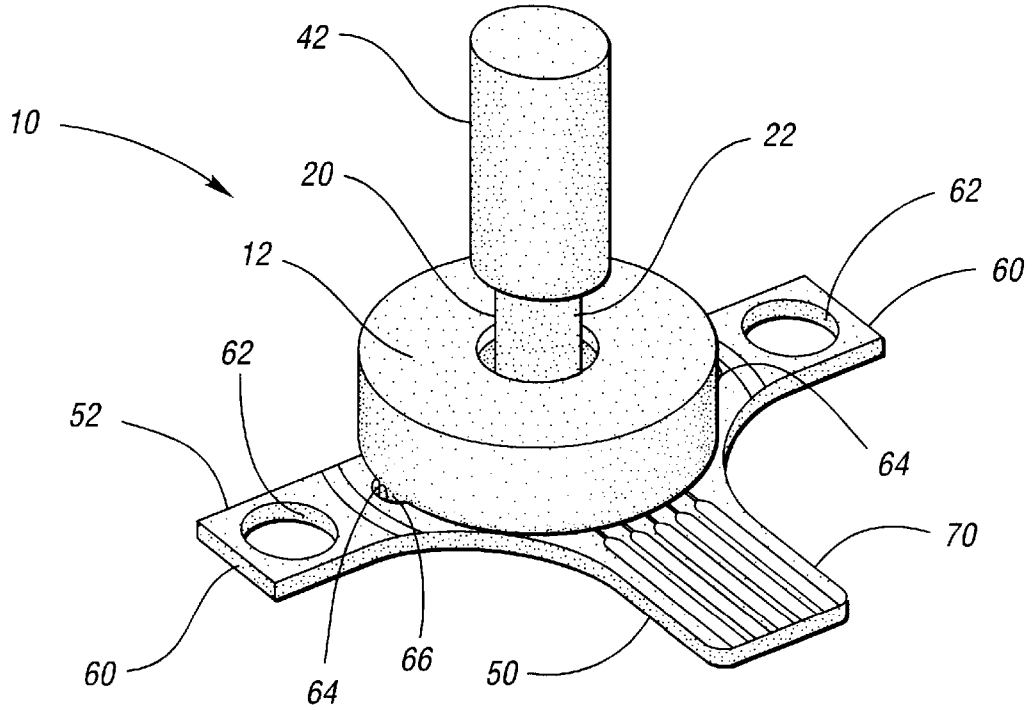
FIG. 1 is an isomatric view of a preferred pointing device of the present invention.

FIGS. 1–6 show a preferred pointing device 10 of the present invention. With reference to FIGS. 1–4, pointing device 10 comprises a retainer shell 12 that partly encloses an actuator 20. Actuator 20 includes an arm 22 having a tip 24 at one end and a force transfer member 26 at the opposite end. Arm 22 is of cylindrical shape having a cross-sectional diameter 32. Force transfer member 26 is of spherical segment shape having an arcuate bottom surface 28 characterized by a bottom surface radius 34 and having a height 36. Arm 22 extends through a hole 40 in retainer shell 12 and is partly covered by a cap 42 that provides a frictional contact surface for a user's finger. Force transfer member 26 is attached by an elastomeric adhesive 44 to a force sensor 50. A preferred force sensor 50 includes an array of four force-sensing resistors 51, comprising a sensor substrate 52, a semiconductive layer 54, and conductors 56 in an interdigitated pattern. (In FIG. 4, the length of radius 34 is exaggerated; therefore, other components of pointing device 10 are also not drawn to scale.) Sensor substrate 52 includes two mounting flanges 60, each having a first mounting hole 62 for attaching pointing device 10 to a device such as a keyboard and a second mounting hole 64 for receiving a mounting finger 66 extending from shell 12 and secured to substrate 52. Sensor substrate 52 also includes an interconnect flange 70 having five contacts 72 for electrically connecting pointing device 10 to a host device. The five contacts 72, one for each of the four force-sensing resistors 51 and one common contact, are used to apply a voltage between interdigitated conductors 56 of each force-sensing resistors 51.

Figure 6:
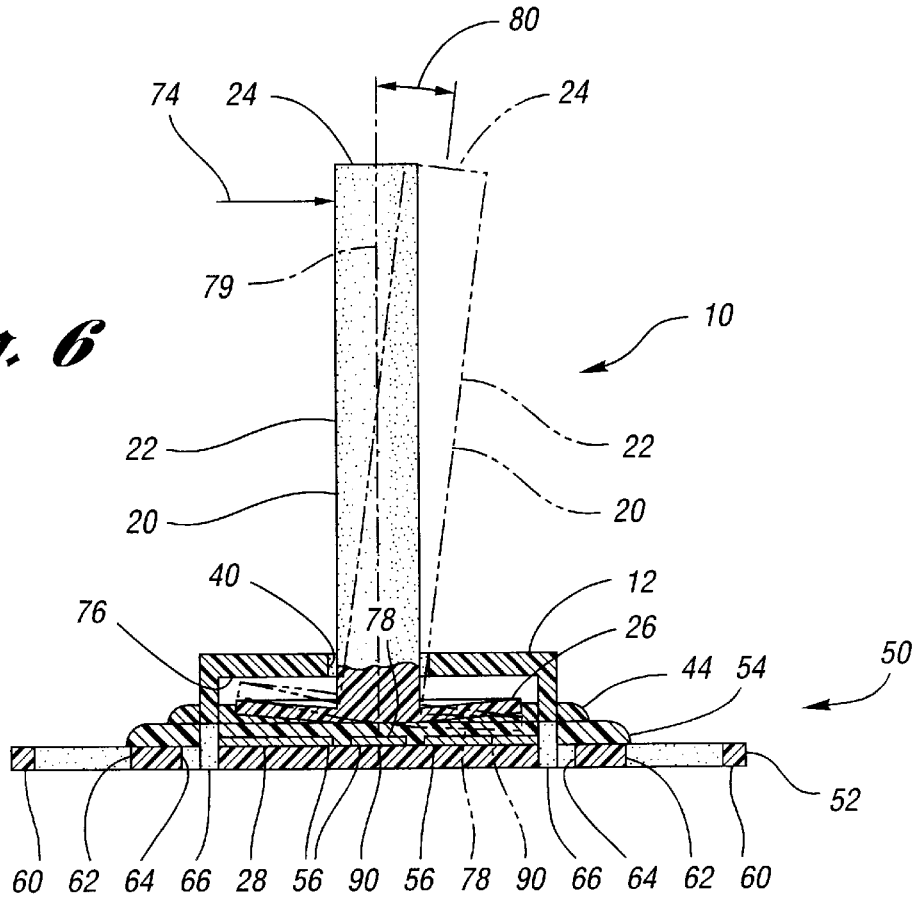
FIG. 6 is similar to FIG. 4 with certain details omitted for clarity and showing the actuator in phantom lines to indicate an exemplary operating condition.

A user operates pointing device 10 by manually applying a directional force 74 (FIG. 6) to tip 24 through cap 42 (not shown in FIG. 6). Force 74 provides a torque that tends to rock actuator 20 on bottom surface 28. As arm 22 moves through a small angle, relative to a reference axis 79 defined by the position of actuator 20 at rest, tip 24 travels through a travel distance less than or equal to a maximum angular travel distance 80 and force transfer member 26 applies pressure through elastomeric adhesive 44 to sensor 50. For ergonomic reasons, it is desirable that maximum travel distance 80 be close or equal to zero.

Pointing device 10 is characterized by a sensitivity parameter, which is defined as the change in electrical output of device 10 corresponding to a change in the direction and magnitude of applied force 74. The sensitivity of pointing device 10 depends upon the sensitivity of sensor 50 and upon the shape of actuator 20. An actuator 20 having a force transfer member 26 with a flat bottom, i.e., an infinite radius 34, would have a maximum travel distance 80 close to zero but would have low sensitivity. An actuator 20 having a relatively small radius 34 would have excellent sensitivity but an excessive maximum travel distance 80.

The shape of force transfer member 26 is optimized to minimize the travel distance of arm 22 while maximizing the sensitivity of pointing device 10. A preferred force transfer member 26 has a curved bottom surface 28 with radius of curvature 34 equal to between twenty and thirty times cross-sectional diameter 32 of arm 22. For example, in one embodiment, arm 22 has a cross-sectional diameter 32 of 0.125 in (3.2 mm) and a bottom surface radius of curvature 34 of approximately 8.0 in (20.3 cm). A preferred force transfer member 26 is approximately 0.370 in (9.40 mm) wide and 0.030 in (0.76 mm) thick, and arm 22 is approximately 0.375 in (9.5 mm) long. Such a design results in a sensitive pointing device 10 having a very small maximum travel distance 80, resulting in a close approximation to an ergonomically desirable isometric pointing device.

Figure 5:
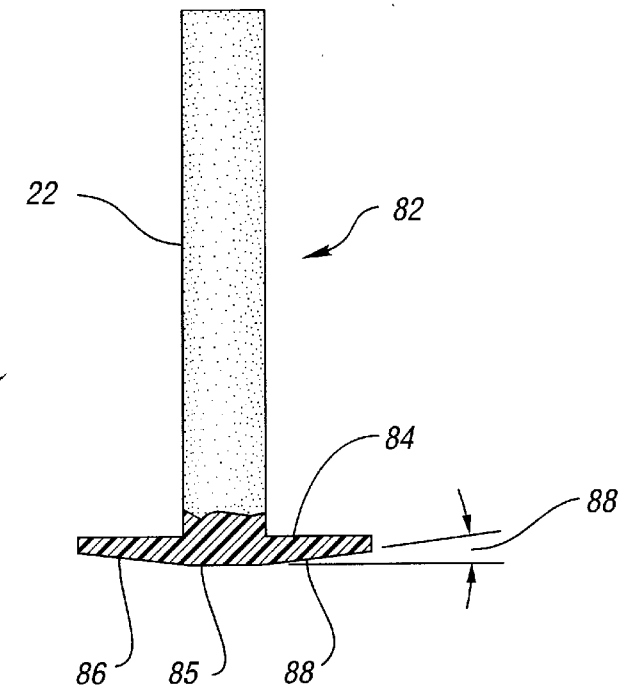
FIG. 5 is a sectional view of an alternative embodiment of an actuator of the present invention.

FIG. 5 shows another embodiment of an actuator 82 comprising a force transfer member 84 having a flat bottom surface 85 with a bevel 86. A preferred bevel angle 88 is between 1" and 2" with bevel 86 beginning approximately ¼ of the way between he center of the bottom surface and the edge of force transfer member 84. Bottom surface 85 can also include multiple bevels or a combination of flat, bevelled, and rounded areas.

When force 74 (FIG. 6) is applied to arm 22, bottom surface 28 of force transfer member 26 rocks slightly on elastomeric adhesive 44 and force sensor 50, thereby changing the portion of bottom surface 28 that transfers force to sensor 50 and changing the location and magnitude of the forces applied to sensor 50. Individual force-sensing resistors 51 detect the magnitude and position of the force applied to sensor 50. In one embodiment, sensor 50 comprises a circular array of four force-sensing resistors 51, each configured as a ninety degree circular segment. The output of each pair of opposing force-sensing resistors 51 is compared, for example, by using a differential amplifier, to determine the two-dimensional components of force 74. With appropriate circuitry that would be obvious to skilled persons, the electrical signal from force-sensing resistors 51 can also be used to determine a downward component of force 74, thereby allowing measurement of forces in three dimensions.

Other configurations of sensor 50 can be used with appropriate known circuitry to determine one, two, or three dimensional components of force 74. For example, a circular array of three force-sensing resistors 51, each configured as a 120 degree circular segment, could be used to measure forces in two or three dimensions. A configuration of two or even one force-sensing resistors 51 could be used to measure forces in one or two dimensions.

Force 74 is transferred at a single, contiguous area 90, the location and size of which changes as the applied force changes. Such a force transfer mechanism affords improved sensitivity and control compared to prior are force transfer mechanisms. A first portion of the rounded or bevelled bottom surface 28 presses into and compresses sensor 50 and a second, opposing portion tends to lift up from sensor 50 and thereby creates a tension in elastomeric adhesive 44.

A pivot point 78 that changes position as the applied force changes, separates the first and second portions. The rocking of actuator 20 is slight enough so that the tension does not release force transfer member 26 from elastomeric adhesive 44.

Retainer shell 12 defines the maximum travel distance 80 of arm 22 because hole 40 is sufficiently large to permit only a predetermined amount of travel distance of arm 22. Excessive travel of actuator 20 that would tend to free it from elastomeric adhesive 44 is thereby prevented. For example, in an embodiment in which arm 22 has a cross-sectional diameter of 0.125 in (3.18 mm), hole 40 has a diameter 92 (FIG. 4) of approximately 0.142 in (3.61 mm), resulting in an annular gap 94 having a width of between 0.008 in (0.203 mm) and 0.009 in (0.229 mm) between arm 22 and retainer shell 12.

The space between elastomeric layer 44 and the inside top surface 96 defines an interior height 100. Interior height 100 is slightly greater than height 36 of force transfer member 26, thereby producing a small gap 102 that allows actuator 20 to rock in response to applied force 74. Gap 102 also allows actuator 20 to expand and contract as its temperature changes, without external constraints that would produce significant force on sensor 50. In a preferred embodiment, gap 102 is approximately 0.020 in (0.508 mm) wide. Gap 102 is sufficiently small to prevent actuator 20 from detaching from elastomeric adhesive 44 by limiting the angular motion of actuator 20.

Figure 2:
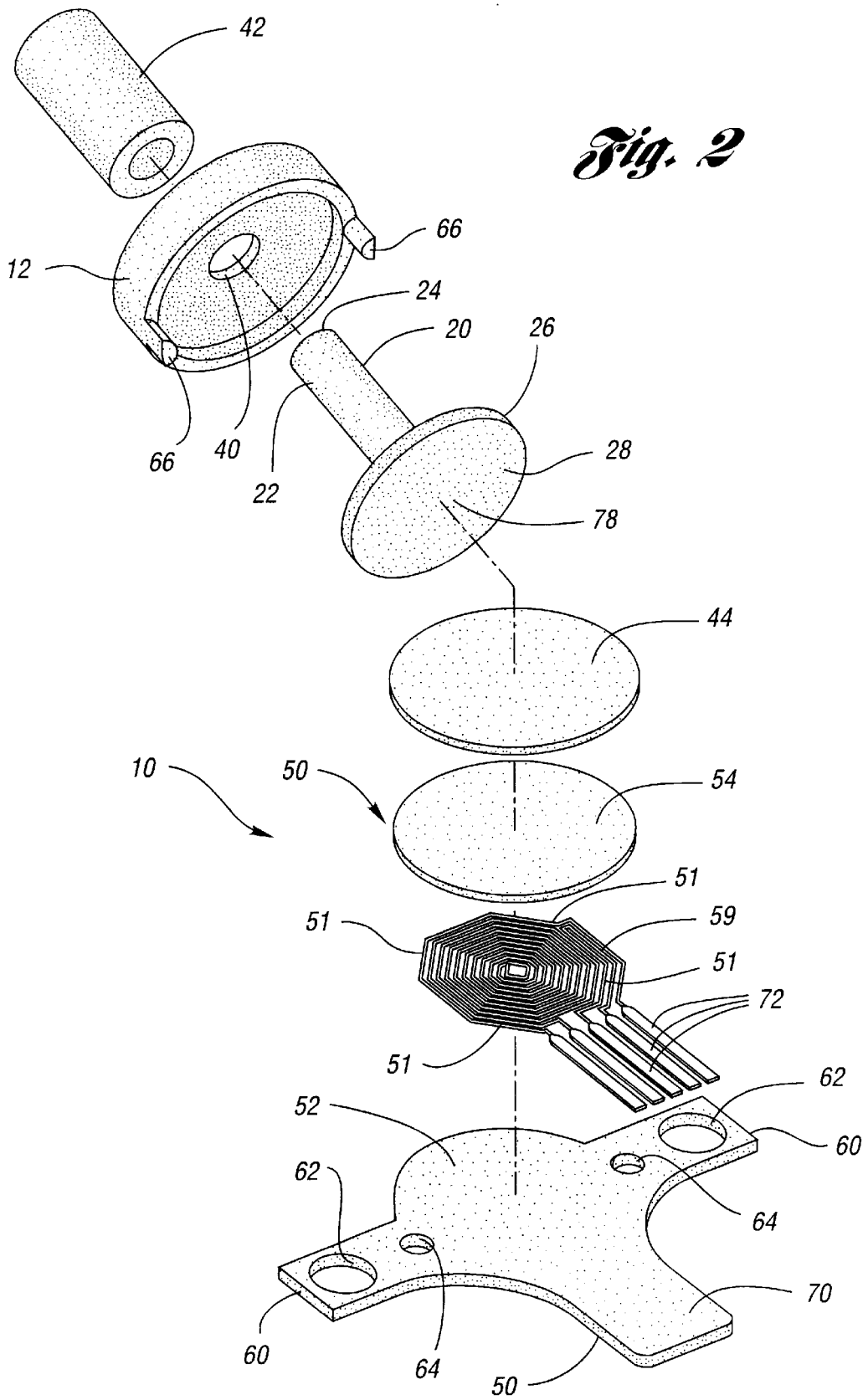
FIG. 2 is an exploded view of the pointing device of FIG. 1.
Figure 3:
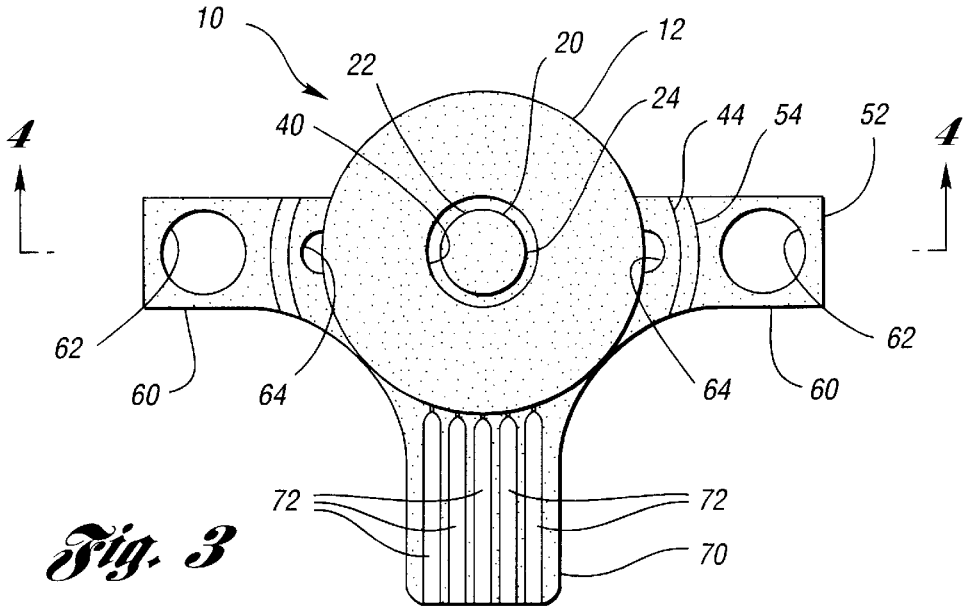
FIG. 3 is a plan view of the pointing device of FIG. 1.
Figure 4:
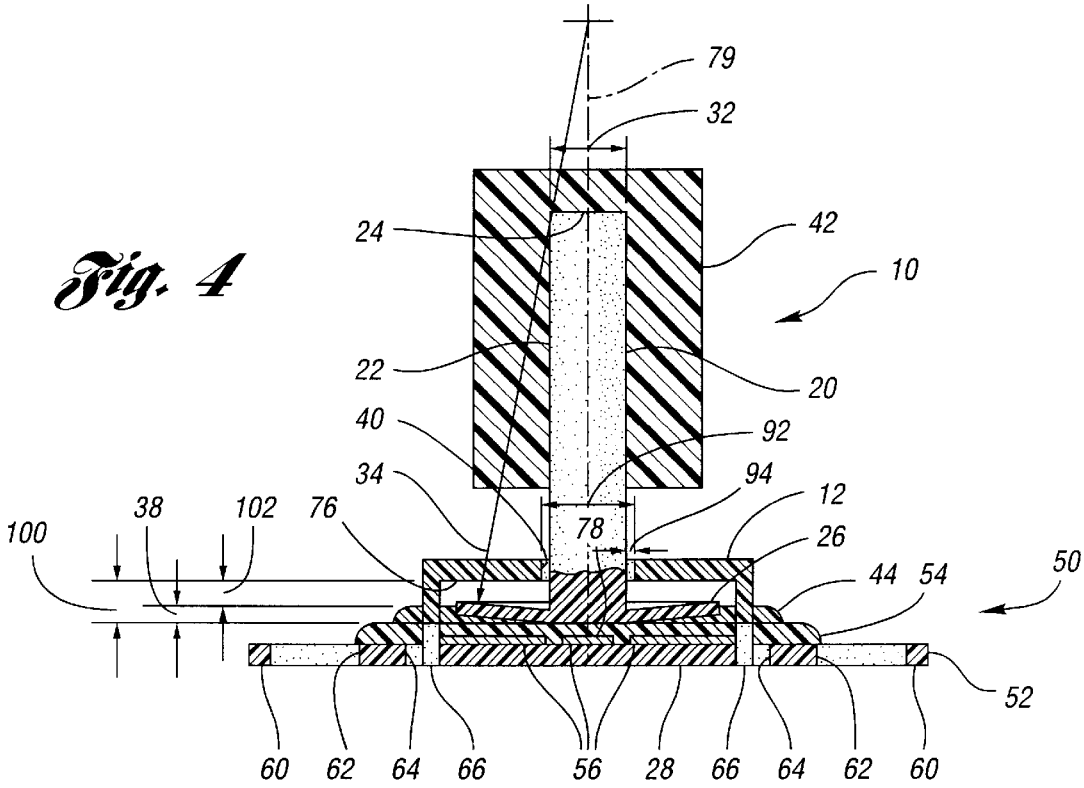
FIG. 4 is a sectional view taken along the lines 4—4 of FIG. 3 showing in exaggerated detail the curvature of the bottom of the force transfer member and the thicknesses of the elastomeric adhesive, semiconductive layer, and conductive layers.

A preferred actuator 20 is manufactured from a fiberglass-filled polycarbonate. Elastomeric adhesive 44 has adequate bond strength and is sufficiently elastic to allow force transfer member 26 to rock slightly without breaking the bond as arm 22 is displaced. A preferred elastomeric adhesive 44 comprises a layer approximately 0.005 in (0.127 mm) thick of VRB Adhesive from 3M, Minneapolis, Minn. Sensor 50 preferably comprises a four-zone, force-sensing resistor, as described in U.S. Pat. No. 4,489,302 to Eventoff for "Electronic Pressure Sensitive Force Transducer" and available from Interlink Electronics of Camarillo, Calif. In the preferred embodiment, the four force-sensing zones are either contiguous or actually overlap, as shown in FIG. 2. Other force sensors, such as strain gauges or piezoelectric transducers, can also be used.

Figure 7:
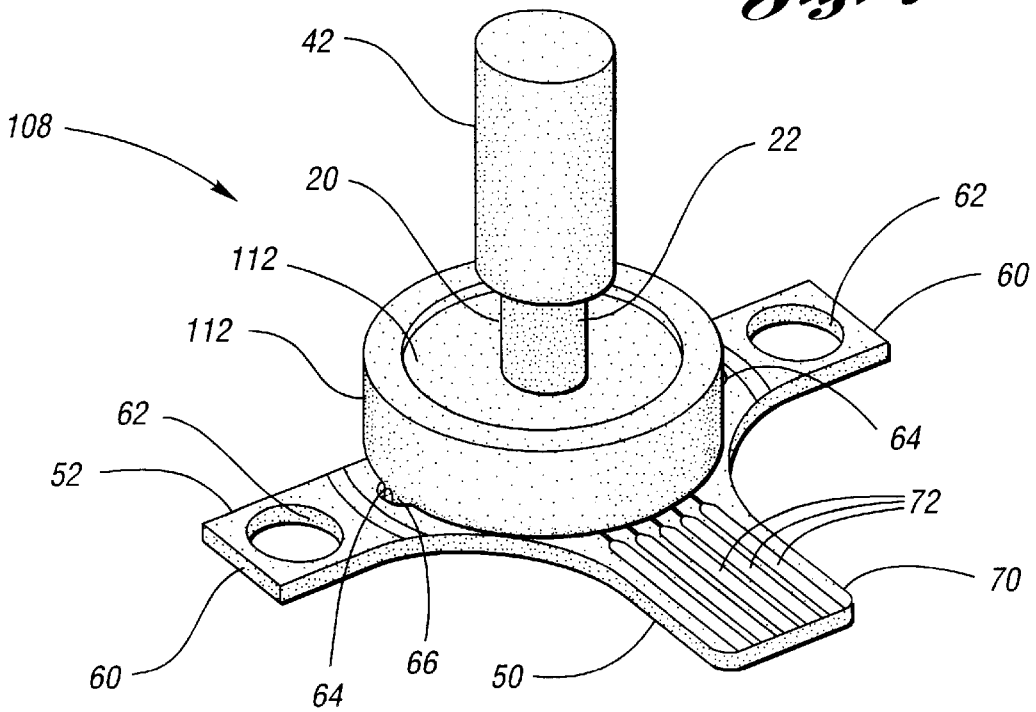
FIG. 7 is an isometric view of an alternative preferred pointing device of the present invention using a different method of retaining the actuator within the pointing device.

FIGS. 7, 8, and 9 show an alternative preferred embodiment of a pointing device 108 that uses a retainer ring 110 and a potting compound 112 in place of retainer shell 12. Retaining ring 110 serves to contain potting compound 112. Potting compound 112 is sufficiently soft that it does not significantly constrain actuator 20 from expanding or contracting as its temperature changes and, therefore, does not cause extraneous forces to be registered by sensor 50. Potting compound 112 is also sufficiently soft that is does not prevent small angular motion of actuator 20.

Potting compound 112 does, however, restrict the maximum angular travel distance of arm 22, thereby preventing separation of actuator 20 from elastomeric adhesive 44. Potting compound 112 also prevents actuator 20 from falling out of pointing device 10 if the bond between elastomeric adhesive 44 and force transfer member 26 were to momentarily fail. A preferred potting compound is an electronics-grade silicone compound, such as that available from EMS, Indianapolis, Ill.

Pointing devices 10 and 108 are suited for use as an integrated pointing devices on a computer keyboard. Because of their environmental stability, pointing device 10 and 108 are particularly will adapted for use on portable computers that are operated in varying environments. Using force-sensing resistors for sensor 50 results in an expensive yet stable force-sensing pointing device especially adapted to high-volume manufacturing.

Figure 10:
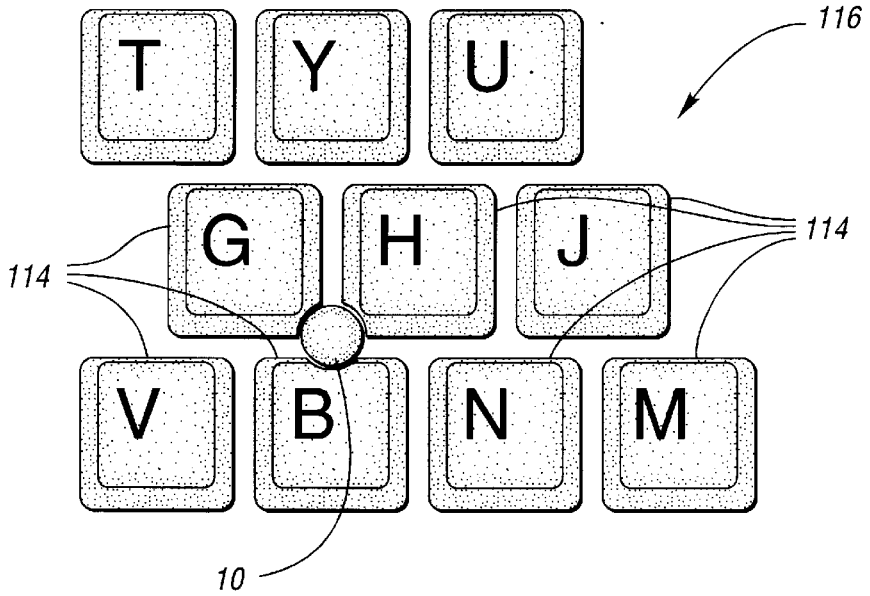
FIG. 10 is a fragmentary plan view of a keyboard showing a pointing device of the present invention positioned between certain alphanumeric keys.
Figure 11:
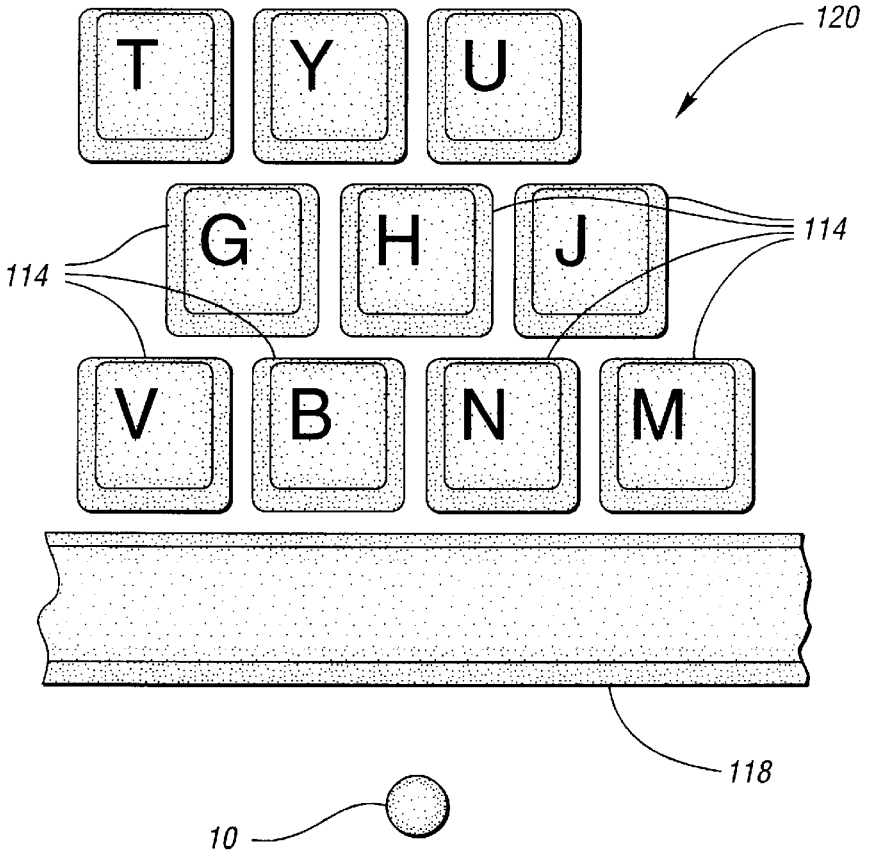
FIG. 11 is a fragmentary plan view of a keyboard showing a pointing device of the present invention apart from the alphanumeric keys.

FIG. 10 shows, by way of example, pointing device 10 positioned between alphanumeric keys 114 of a keyboard 116. FIG. 11 shows, by way of example, pointing device 10 positioned apart from the alphanumeric keys 114 on the opposite side of a space bar 118 of a keyboard 120. Pointing device 10 could also be incorporated into one of alphanumeric keys 114 by modifying arm 22 and using a key cap in place of cap 42. The output of sensor 50 could be interpreted as an analog force or as a digital key input depending upon whether another key, such as the ALT key, is pressed simultaneously. Alternatively, the key could incorporate a separate mechanism to register a keystroke and act only as an analog force sensor under certain conditions, for example, when the key is maintained in a depressed condition.

It will be obvious that many changes may be made to the above-described details of the invention without departing from the underlaying principles thereof. For example, although the invention is referred to as a cursor control device, the output of the device can be used to change parameters other than cursor position. For example, the device could be used to scroll through a number of selections or to change the pitch of an audio device. The shape of the actuator can be varied from that described above. The scope of the present invention should, therefore, be determined only by the following claims.

We claim:

1. An analog pointing device, comprising:

an arm having first and second ends;

a force transfer member affixable to the second end of the arm;

a force sensor detecting a force having a magnitude applied to the first end of the arm such that the force is transferred through the arm and the force transfer member to the force sensor; and an elastomeric member affixable to the force sensor and the force transfer member, whereby the force sensor produces an analog output proportional to the magnitude of the force.

2. A computer system comprising:

a display;

an analog pointing device for controlling cursor movement on the display, the analog pointing device comprising:

an arm having first and second ends;

a force transfer member affixable to the second end of the arm;

a force sensor detecting a force having a magnitude applied to the first end of the arm such that the force is transferred through the arm and the force transfer member to the force sensor; and an elastomeric member affixable to the force sensor and the force transfer member, whereby the force sensor produces an analog output proportional to the magnitude of the force.

* * * * *